US007255117B1

(12) United States Patent
Drake, Sr.

(10) Patent No.: US 7,255,117 B1
(45) Date of Patent: Aug. 14, 2007

(54) UMBRELLA RETAINING APPARATUS

(76) Inventor: James E. Drake, Sr., 932 Cambridge Ave., Aberdeen, MD (US) 21001

( * ) Notice: Subject to any disclaimer, the term of this patent is extended or adjusted under 35 U.S.C. 154(b) by 254 days.

(21) Appl. No.: 10/713,985

(22) Filed: Nov. 14, 2003

(51) Int. Cl.
*A45B 25/12* (2006.01)

(52) U.S. Cl. ..... 135/16; 24/570

(58) Field of Classification Search ..... 135/20.3, 135/16, 98, 34.2, 37; 108/50.12; 224/915; 24/570

See application file for complete search history.

(56) References Cited

U.S. PATENT DOCUMENTS

| | | | | |
|---|---|---|---|---|
| 123,380 | A * | 2/1872 | Clarke | 248/515 |
| 840,551 | A | 1/1907 | Baumgarten | |
| 1,410,173 | A | 3/1922 | De Nobili | |
| 1,425,806 | A | 8/1922 | Swift | |
| 2,373,471 | A | 4/1945 | Hannan | |
| 3,606,651 | A | 9/1971 | Goodman | |
| 3,958,306 | A | 5/1976 | Kuusisto | |
| 4,321,003 | A * | 3/1982 | Castle | 414/440 |
| D279,834 | S | 7/1985 | Falzett | |
| D381,847 | S * | 8/1997 | Shingles | D6/513 |
| 6,223,759 | B1 * | 5/2001 | Flippin, Jr. | 135/34.2 |

FOREIGN PATENT DOCUMENTS

JP 2003079417 A * 3/2003

* cited by examiner

*Primary Examiner*—James R. Brittain

(57) ABSTRACT

An apparatus for preventing a closed outdoor table umbrella from opening. To attain this, a continuous ring fixably attached to a distal end of a long handle is placed around the body of an umbrella. In use, a user extends the ring above the umbrella, and lowers it until snug about the umbrella. In an embodiment, the long handle includes a hand-hold at its proximal end. Such a hand-hold may rest upon an outdoor table-top while an attached ring is in place about an umbrella extending up from the center of the table. Also, a method of retaining an umbrella.

4 Claims, 3 Drawing Sheets

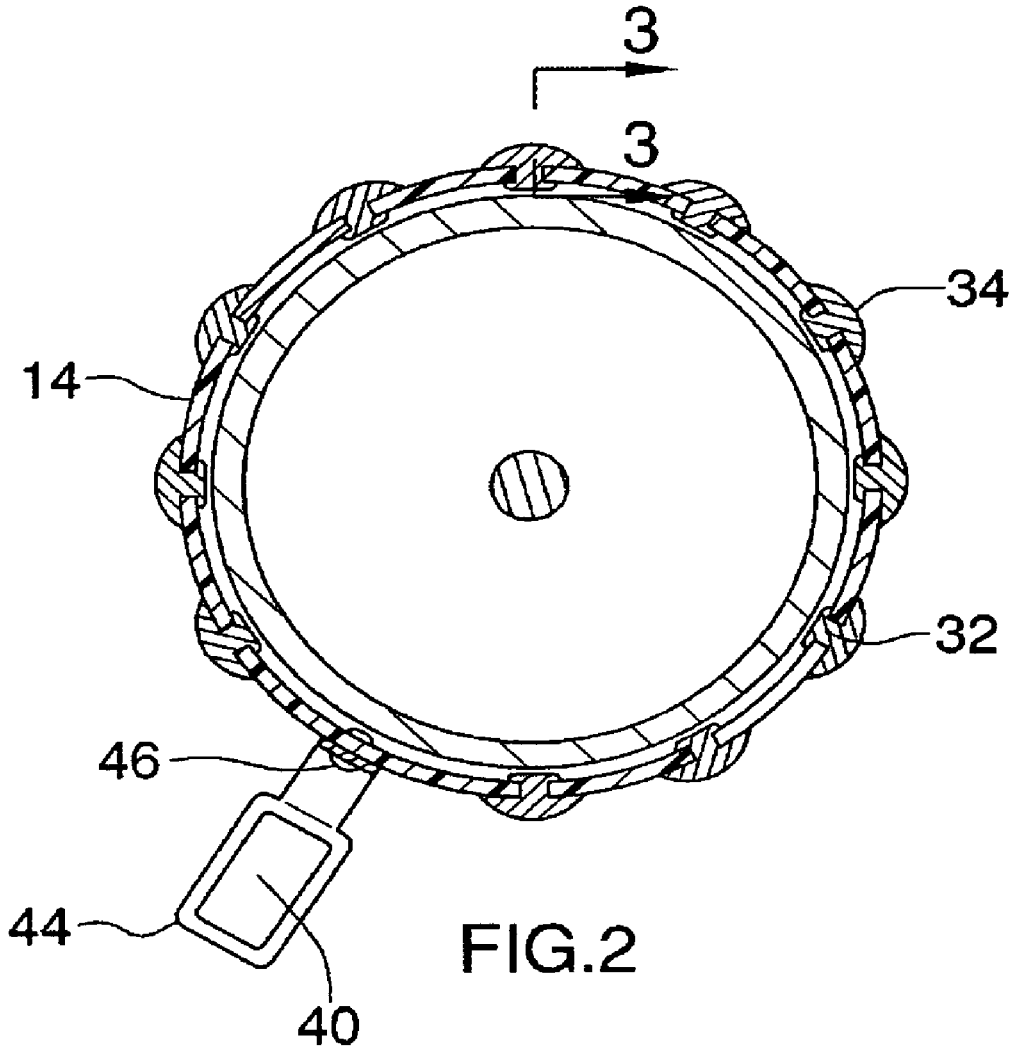
FIG.2
FIG.3
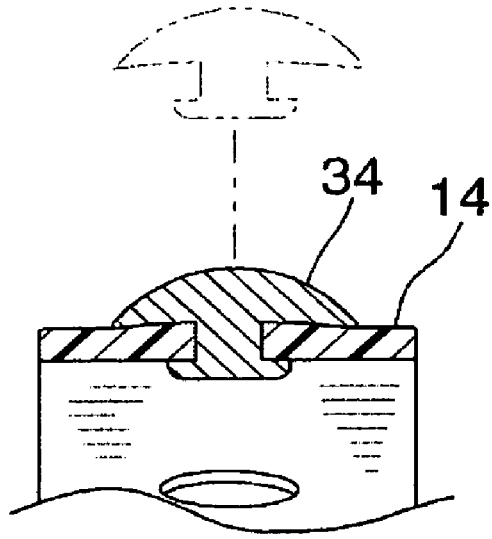

UMBRELLA RETAINING APPARATUS

BACKGROUND OF THE INVENTION

1. Field of the Invention

The present invention relates to an umbrella retaining apparatus for use in connection with holding an umbrella closed. The umbrella retaining apparatus has particular utility in connection with preventing an umbrella from being transported in wind gusts.

2. Description of the Related Art

An umbrella retaining apparatus is desirable for preventing a pole umbrella from moving about in the wind.

The use of umbrella fasteners for hand-held umbrellas is known in the prior art. For example, U.S. Pat. No. 3,958,306 to Kuusisto discloses an umbrella fastener having a tapered hollow truncated cylinder and a holding means attached to one end of the cylinder, thus enabling a user to hold and carry the cylinder and the umbrella by hand.

U.S. Pat. No. 1,425,806 to Swift discloses an open, tensioned band for engaging and holding the end of the ribs of an umbrella when closed. However, the Swift '806 patent does not disclose a continuous ring fixably attached to a handle having two orthogonal components, where the ring is configured to be arranged around the canopy-forming portion of an umbrella.

Similarly, U.S. Pat. No. 1,410,173 to DeNobili discloses an umbrella ring that is hinged. However, the DeNobili '173 patent does not disclose a continuous ring fixably attached to a handle having two orthogonal components, where the ring is configured to be arranged around the canopy-forming portion of an umbrella.

U.S. Pat. No. 3,606,651 to Goodman discloses a clamping device designed to keep articles of clothing together while laundering. However, the Goodman '651 patent does not disclose a continuous ring fixably attached to a handle having two orthogonal components, where the ring is configured to be arranged around the canopy-forming portion of an umbrella.

U.S. Pat. No. 840,551 to Baumgarten discloses an umbrella clasp having an open, spring-metal clasp. However, the Baumgarten '551 patent does not disclose a continuous ring fixably attached to a handle having two orthogonal components, where the ring is configured to be arranged around the canopy-forming portion of an umbrella.

U.S. Pat. No. 2,373,471 to Hannan discloses an umbrella retaining device that is used with a hand-held umbrella. However, the Hannan '471 patent does not disclose a continuous ring fixably attached to a handle having two orthogonal components, where the ring is configured to be arranged around the canopy-forming portion of an umbrella.

Lastly, U.S. Design Pat. No. 279,834 to Falzett appears to disclose an umbrella runner that is circular having arched cutouts therearound. However, the Falzett '834 patent does not disclose a continuous ring fixably attached to a handle having two orthogonal components, where the ring is configured to be arranged around the canopy-forming portion of an umbrella.

While the above-described devices fulfill their respective, particular objectives and requirements, the aforementioned patents do not describe an umbrella retaining apparatus that allows a user to secure an upright, outdoor table umbrella. The Kuusisto '306 patent makes no provision for securing an upright, outdoor table umbrella.

Therefore, a need exists for a new and improved umbrella retaining apparatus which can be used to hold closed a very large, upright umbrella. In this regard, the present invention substantially fulfills this need. In this respect, the umbrella retaining apparatus according to the present invention substantially departs from the conventional concepts and designs of the prior art, and in doing so provides an apparatus primarily developed for the purpose of securing an outdoor umbrella in windy conditions.

SUMMARY OF THE INVENTION

In view of the foregoing disadvantages inherent in the known types of umbrella fasteners now present in the prior art, the present invention provides an improved umbrella retaining apparatus, and overcomes the above-mentioned disadvantages and drawbacks of the prior art. As such, the general purpose of the present invention, which will be described subsequently in greater detail, is to provide a new and improved umbrella retaining apparatus and method of retaining an umbrella which has all the advantages of the prior art mentioned heretofore and many novel features that result in a umbrella retaining apparatus which is not anticipated, rendered obvious, suggested, or even implied by the prior art, either alone or in any combination thereof.

To attain this, the present invention essentially comprises a continuous ring fixably coupled to a handle having a distal end and a proximal end, where the distal end is perpendicular to the proximal end, where the distal end is attached to the ring, and where the proximal end is configured to be held by a user.

There has thus been outlined, rather broadly, the more important features of the invention in order that the detailed description thereof that follows may be better understood and in order that the present contribution to the art may be better appreciated.

The invention may also include a telescoping handle allowing users of a variety of heights to effectively use the device. Also, the invention may include a variety of decorative embellishments which may be removably attached to the ring. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved umbrella retaining apparatus that has all of the advantages of the prior art umbrella fasteners and none of the disadvantages.

It is another object of the present invention to provide a new and improved umbrella retaining apparatus that may be easily and efficiently manufactured and marketed.

An even further object of the present invention is to provide a new and improved umbrella retaining apparatus that has a low cost of manufacture with regard to both materials and labor, and which accordingly is then susceptible of low prices of sale to the consuming public, thereby making such umbrella retaining apparatus economically available to the buying public.

Still another object of the present invention is to provide a new umbrella retaining apparatus that provides in the apparatuses and methods of the prior art some of the advantages thereof, while simultaneously overcoming some of the disadvantages normally associated therewith.

Even still another object of the present invention is to provide a umbrella retaining apparatus for securing outdoor umbrellas in windy conditions. Lastly, it is an object of the present invention to provide a new and improved method of securing an umbrella.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a cross-section view of an embodiment of the apparatus of the present invention. The cross-section is taken on line 2 of FIG. 1.

FIG. 3 is a cross-section view of an embodiment of the apparatus of the present invention. The cross-section is taken on line 3 of FIG. 2.

The same reference numerals refer to the same parts throughout the various figures.

Figure 1:
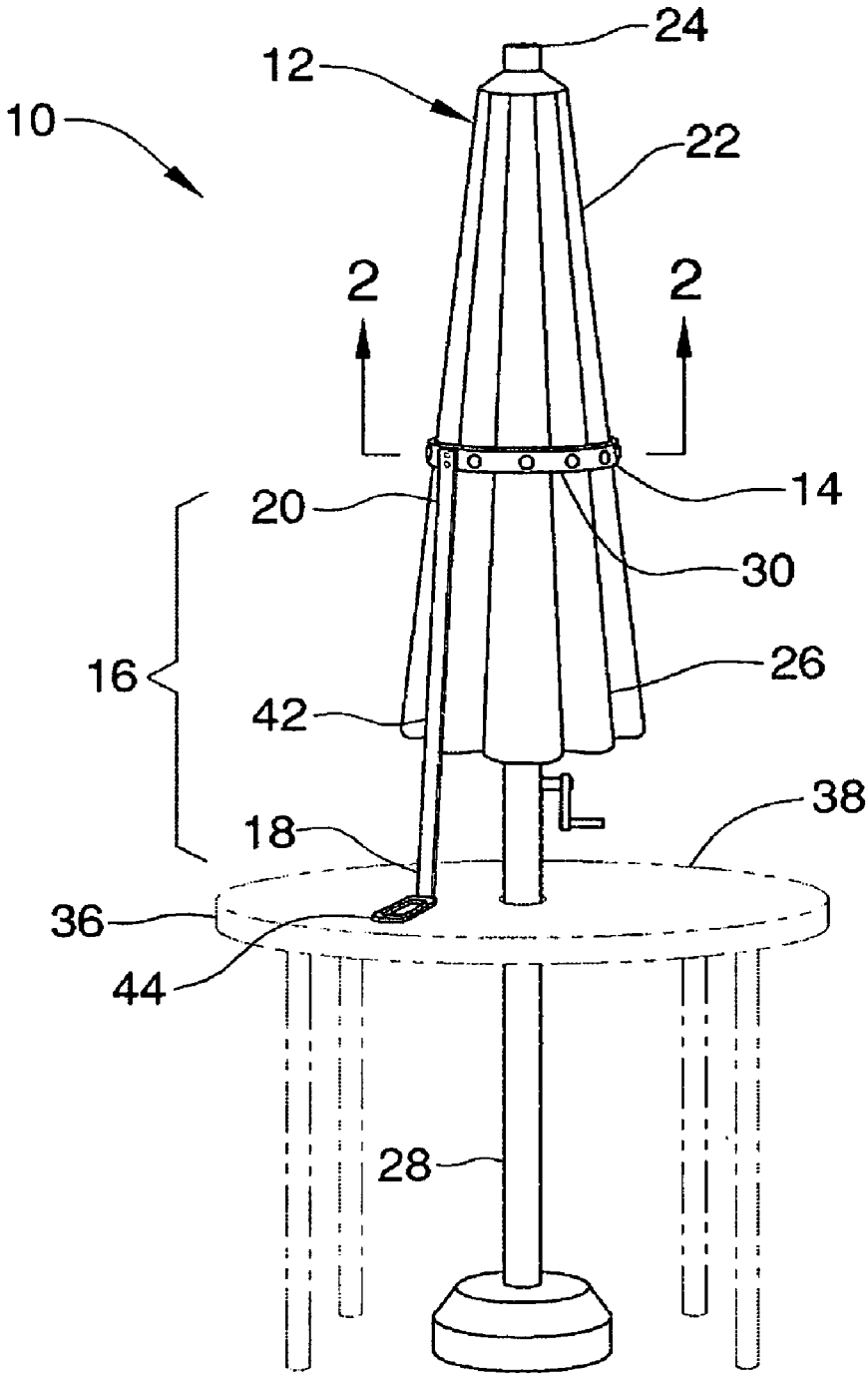
FIG. 1 is an oblique view of an embodiment of the apparatus of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF PREFERRED EMBODIMENTS

Referring now to the drawings, and particularly to FIGS. 1-4, a preferred embodiment of the umbrella retaining apparatus of the present invention is shown and generally designated by the reference numeral 10.

In FIG. 1, a new and improved umbrella retaining apparatus 10 of the present invention for holding an outdoor umbrella closed in windy weather is illustrated and will be described. More particularly, the umbrella retaining apparatus 10 comprises a ring 14. Ring 14 may be constructed of any rigid, weather resistant material. In the preferred embodiment shown, the ring is constructed of plastic or composite material. Ring 14 is configured such that an inner diameter is less than an outer diameter of the largest circumference of the canopy-forming portion 22 of an umbrella 12. For example, an umbrella typically includes a number of ribs 26, where the ribs are connected to a flexible material and where the ribs and the material form a canopy when the umbrella is open. The ring 14 of the present invention is configured to rest around this canopy-forming portion 22 of an umbrella 12 while the umbrella is closed. When the umbrella is closed the ribs 26 are substantially parallel to the center post 28 of the umbrella.

In the case of a table mounted, outdoor umbrella such as that illustrated, a user cannot reach above the uppermost point 24 of the umbrella to install the ring. Consequently, the umbrella-retaining apparatus of the instant application includes a handle 16. Such handle enables a user to raise the ring 14 above an uppermost point 24 of the umbrella.

The handle 16 includes a distal end 20 and a proximal end 18. The distal end 20 is fixably coupled to the ring. In an embodiment, the distal end 20 is coupled to the ring using mounting hardware 46 such as rivets. Further, the distal end of the handle is fixably attached to the ring such that the distal end of the handle and a sidewall 30 of the ring are substantially perpendicular to one another. The proximal end 18 of the handle is adapted to be held by a user. In the preferred embodiment shown, the proximal end 18 of the handle comprises a hand-hold 44. In an embodiment, the hand-hold is rectangular, allowing the fingers of a human hand to pass therethrough. As more clearly illustrated in FIG. 2, the hand-hold includes a rectangular cut-out area 40. Hand-hold 44 is adapted to sit upon a tabletop 38, as shown in FIG. 1. In this manner, the weight of the ring 14 is essentially supported by the tabletop 38. Extending between the distal end 20 and the proximal end 18 is a rod-like member 42. Such rod-like member may be extendable in an embodiment.

Turning to FIG. 2, a cross-section taken on line 2 of FIG. 1 is shown. As shown, the ring 14 may include a number of cutout areas 32. Such cutout areas are arranged through the sidewall of the ring and may be fitted with embellishments 34. Embellishments are constructed of a malleable material having memory. As such, the embellishments may include 'feet' configured to pass through the cutout area, yet once through are large enough to hold the embellishment in place. As shown in FIG. 3 is a cross-sectional view of line 3 of FIG. 2.

Figure 4:
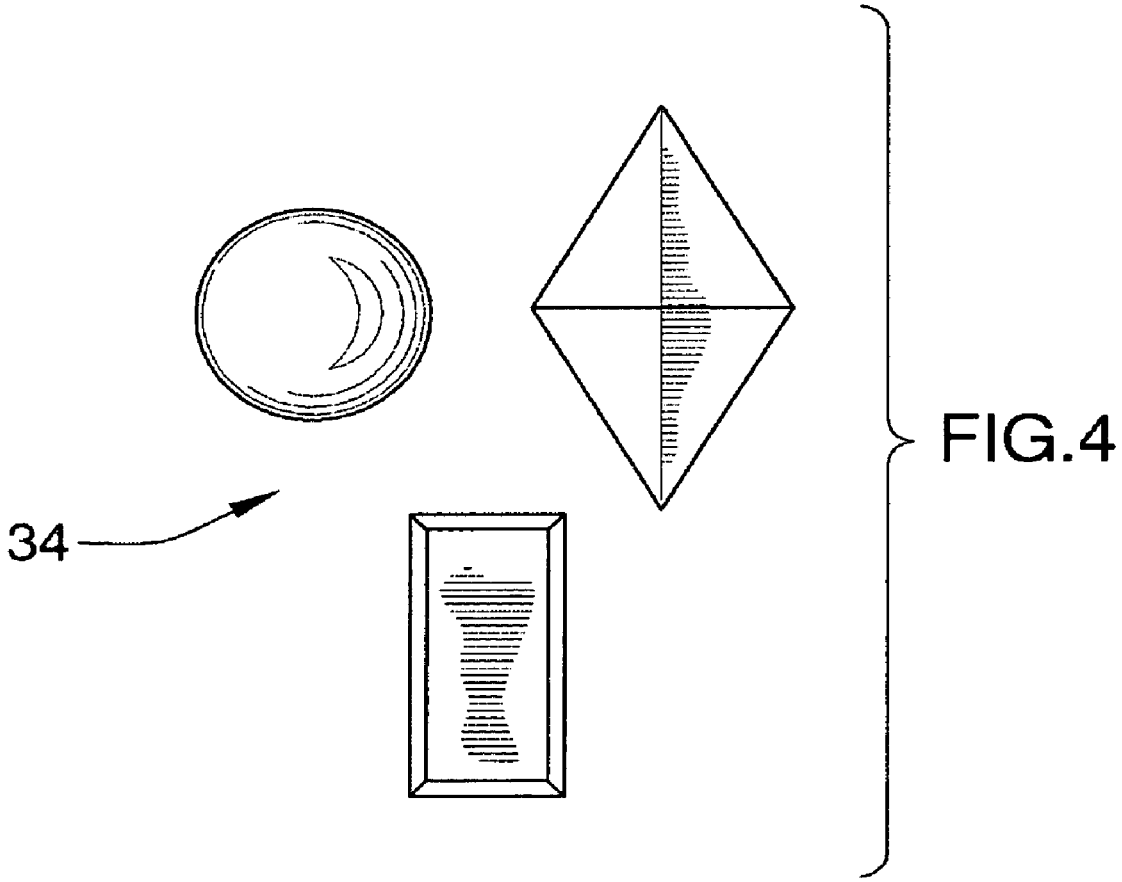
FIG. 4 shows a number of embellishments for the ring.

Turning to FIG. 4, a number of embellishments 34 are shown. Consequently, embellishments may be circular, triangular, diamond-shaped, or emerald shaped, or any decorative shape as may be desired by a user. Further, the embellishments may be rearranged or replaced as desired. Consequently, the embellishments may be changed to correspond with various events and holidays. Therefore, the embellishments may be in any decorative form.

In use, it can now be seen the ring 14 is decorated using any embellishments 34 desired by the user. The user grasps a proximal end of the handle, and with the aid of the handle raises the ring 14 above an uppermost point of a closed, vertically-mounted umbrella. The user then slides the ring 14 down around the canopy-forming portion of the umbrella. In an embodiment, the ring is slid downward until a hand-hold of the handle comes to rest on the tabletop. In an embodiment, the ring is slid downward until the inner diameter of the ring is approximately equivalent to the circumference of the canopy-forming portion of the umbrella. The ring acts to hold the umbrella in a closed position, thus preventing the umbrella from opening in the wind.

While a preferred embodiment of the umbrella retaining apparatus has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as metal, cardboard, or a variety of wood may be used instead of the plastic ring described. And although keeping a table-mounted umbrella closed has been described, it should be appreciated that the umbrella retaining apparatus herein described is also suitable for holding closed any manner of umbrellas. Furthermore, a wide variety of embellishments may be used to decorate the ring instead of those described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. In combination with a stationary closed outdoor umbrella including a body, the improvement which comprises:

a rigid rig, wherein the ring removably circumscribes the body of the closed outdoor umbrella to prevent said umbrella from opening; and a handle, wherein the handle is fixably coupled to the ring, wherein the handle is utilized to place the ring on the umbrella, and wherein the handle comprises a rod-like member and a hand-hold, wherein the rod-like member extends between the ring and the hand-hold, wherein the rod-like member comprises a proximal end and a distal end, wherein the hand-hold is perpendicular to the rod-like member, wherein the ring is perpendicular to the rod-like member, wherein the hand-hold is coupled to the proximal end, and wherein the ring is coupled to the distal end.

2. The apparatus as recited in claim 1, wherein the ring comprises at least one cutout area and wherein the cutout area is fitted with a removable, user-configurable embellishment.

3. The apparatus as recited in claim 2, wherein the at least one radial cutout area comprises a hole cut through a sidewall of the ring.

4. The apparatus as recited in claim 1, wherein the ring has an inner diameter less than the largest outer diameter of the closed outdoor umbrella.

* * * * *